United States Patent [19]

Carroll

[11] 4,120,131

[45] Oct. 17, 1978

[54] BUILDING STRUCTURE

[75] Inventor: Frank E. Carroll, Barrington, Ill.

[73] Assignee: Carroll Research, Inc., Rolling Meadows, Ill.

[21] Appl. No.: 720,353

[22] Filed: Sep. 3, 1976

[51] Int. Cl.[2] ..... E04B 1/16

[52] U.S. Cl. ..... 52/310; 52/336; 52/338; 52/340; 52/405

[58] Field of Search ..... 52/453, 450, 451, 410, 52/335, 336, 338, 310, 408, 405, 327, 332, 328, 336, 339, 404, 340, 480, 481; 126/271

[56] References Cited

U.S. PATENT DOCUMENTS

| | | | |
|---|---|---|---|
| 2,090,483 | 8/1937 | Mendez | 52/450 |
| 2,174,581 | 10/1939 | Hoge | 52/338 |
| 2,233,054 | 2/1941 | Heeren | 52/338 X |
| 3,320,704 | 5/1967 | Forsythe et al. | 52/335 X |
| 3,496,691 | 2/1970 | Seaburg et al. | 52/450 X |
| 3,619,963 | 11/1971 | Omholt | 52/480 X |
| 3,839,839 | 10/1974 | Tillisch et al. | 52/481 X |
| 3,884,009 | 5/1975 | Frohlich et al. | 52/310 X |
| 3,893,506 | 7/1975 | Laing | 126/271 X |
| 3,918,230 | 11/1975 | Carroll | 52/335 X |

*Primary Examiner*—Price C. Faw, Jr.
*Assistant Examiner*—Carl D. Friedman
*Attorney, Agent, or Firm*—Thomas W. Speckman

[57] ABSTRACT

This invention relates to a sheet metal structural shape for use in building construction having a generally box shape with outwardly extending flanges at one end of the substantially parallel sides and inwardly extending flanges at the other end of the parallel sides forming a slot between the ends of the inwardly extending flanges and a closure between the ends of the outwardly extending flanges closing the space between the sides at that end. The sheet metal structural shape may be advantageously used as a structural shape in deck structures and in wall structures according to this invention. One deck structure of this invention uses the sheet metal structure shape as a sub-purlin, or purlin on short spans, supporting insulation on the bottom outwardly extending flanges and having sheet metal roofing material fastened to the inwardly extending flanges at the top end of the structural shape. Thus, a deck is provided with at least a major portion of the insulation beneath the steel roof decking. Additional insulation may be applied above the steel roof decking and/or poured concrete may be applied above the steel roof decking. The structures of this invention provide lightweight insulated fire resistant structures obtaining hourly fire ratings when preferred materials are used. The wall structure of this invention provides a wall which may be entirely erected from one side, providing especially suitable shaft wall construction.

19 Claims, 9 Drawing Figures

170
164
183
166
19
183
45
10
17
25
26
27

BUILDING STRUCTURE

This invention relates to a sheet metal structural shape and its use in building structures. The sheet metal structural shape of this invention is advantageously used as a sub-purlin or as a purlin in insulated deck structures according to this invention. One roof structure according to this invention uses the sheet metal structural shape as a sub-purlin supporting insulation beneath sheet metal roofing material above which may be placed a weather seal built-up roofing either alone or in combination with additional insulation material or a poured gypsum or lightweight concrete decking. The sheet metal structural shape of this invention may also be advantageously used in fire resistant insulated poured deck structures and in precast or prefabricated deck structures. The sheet metal structural shape of this invention may also be advantageously used as a stud or mullion in interior or exterior building wall construction.

Previously, integral insulation properties were most frequently obtained when conventional metal roof decks were installed covered to the exterior by foam or other roofers' insulation covered with a weatherproof barrier or traffic layers, such as bitumen and roofing felt. Breaks in the weatherproof barrier lead to direct contact of the insulation with water. Such structures do contribute to the spread of a fire in a building under such a metal roof deck. U.S. Pat. No. 3,466,222 is illustrative of recent attempts to overcome such diadvantages. However, the structure shown in the U.S. Pat. No. 3,466,222 patent only slows down fire damage and does not eliminate it, the roof being susceptible to total destruction by the foam disintegrating and permitting the weatherproofing materials to burn even when utilizing an expensive metal deck roof system.

Another attempt to provide insulated metal deck structures is the deck system as described in U.S. Pat. No. 3,844,009 wherein perforated corrugated metal deck is fastened to joists, lightweight insulating concrete is poured upon the metal deck to the top of the corrugations, an insulation board having moisture permeable openings therethrough which prevent passage of concrete through the openings is laid and another layer of concrete is poured above the insulation extending through the openings. A weatherproof roofing is then applied to the exterior of the poured slab. This system has the disadvantages of wet concrete dripping through the metal deck, poor ceiling appearance, no accoustical correction and poor uplift resistance.

Poured gypsum roof deck systems have long been recognized as economical and furnishing a fireproof roof structure. In the conventional poured gypsum roof deck system, gypsum formboard is laid over the steel sub-purlin assembly, a layer of interwoven steel reinforcing mesh placed over the gypsum formboard and poured in place slurry of gypsum concrete applied to conventionally two inches thick. Such roof systems are known to provide satisfactory two hour fire ratings and low flame spread ratings. However, attempts to provide insulation to such roof deck systems has not proved entirely satisfactory. One attempt has been to use perlite aggregate in the gypsum concrete, however, this does not give desired insulation properties. Another attempt has been to provide insulation beneath the roof desk structure, such as in the ceiling structure, however, such insulation either adds to combustion in the interior of the building or is expensive if incombustible mineral fiber is used. Other attempts to provide both satisfactory insulation and fireproof properties have been to utilize formboard which is both fireproof and has insulating properties. Such formboards are those manufactured from mineral fiber materials and fiber glass materials, but these are both expensive and do not provide the desired insulation properties while being more difficult to use in field erection.

The sheet metal structural shape of this invention provides deck structures wherein the insulation is held by the sheet metal structural shape beneath a metal roof deck, providing both desired insulation qualities and accoustical correction. In embodiments of this invention using insulation beneath a metal roof deck, the insulation is further protected by the metal deck from breaks in the weather seal which has caused water-soaking of insulation in previous attempts to insulate metal roof decks. When utilizing the metal roof deck of this invention, lightweight concrete or gypsum concrete may be poured on top of the metal roof deck providing integral uplift resistance and minimal dripping of water through the metal deck, both of which have been problems in previous attempts to combine metal and poured roof decks.

The wall construction according to this invention provides erection processes wherein all of the structural steel, the studs or mullions, may be completely erected and the wall material applied thereafter from one side. This is especially important in shaft wall construction where it is important to effect early closure of a dangerous open shaft. Previous methods of shaft wall erection, such as disclosed in U.S. Pat. No. 3,702,044, require that the closure walls and the studs be erected together by fitting the wall board into the slot of the stud creating a dangerous work environment at the edge of a shaft.

It is an object of this invention to overcome the above disadvantages.

It is an object of this invention to provide a sheet metal structural shape which may be advantageously used in both deck construction and wall construction.

It is another object of this invention to provide sheet metal purlins and sub-purlins suitable for corrugated metal decks and for poured and prefabricated insulating roof decks.

It is yet another object of this invention to provide a metal roof deck structure which has insulation beneath the metal roof deck providing an accoustical and finished ceiling treatment.

It is a further object of this invention to provide an economical insulating and fireproof poured concrete roof deck system.

It is yet another object of this invention to provide a wall structure well suited for interior and exterior building wall construction which is particularly well suited for shaft wall construction.

These and other objects, advantages and features of this invention will be apparent from the description and by reference to the drawings wherein preferred embodiments are shown as:

The sheet metal structural shape of this invention provides excellent structural characteristics while reducing weight and providing a structural shape which can be readily fabricated from sheet metal. It is highly desirable to fabricate structural shapes from sheet metal to minimize energy requirements in production and to conserve steel. Many prior attempts to utilize sheet metal shapes in poured roof construction have not been satisfactory. Some prior attempts have utilized sheet metal ⊥ shapes as substitutes for bulb tees in roof deck construction. These sheet metal ⊥ shapes while providing sufficient strength in the composite assembled poured roof do not have satisfactory strength characteristics themselves and in the erection, bend over or roll when walked upon by the erectors. This results in a very dangerous situation for the workers. The sheet metal structural shapes of this invention provide desirable strength characteristics themselves and sufficient strength characteristics to be walked upon during erection without dangerous bending or rolling.

Figure 1:
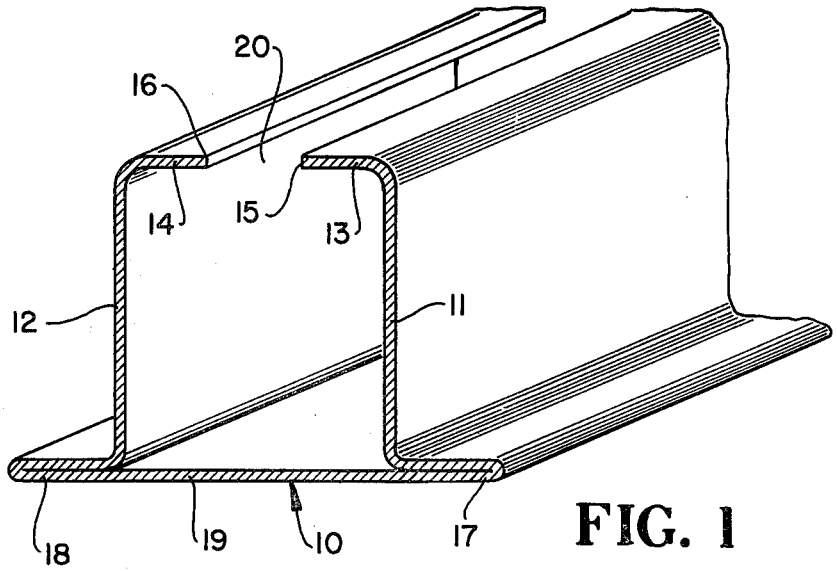
FIG. 1 is a perspective sectional view of a sheet metal structural shape according to this invention.

Referring to FIG. 1, the sheet metal shape utilized in this invention is shown as flanged box section 10 symmetrical about a bisecting plane having opposing generally parallel and equal length sides 11 and 12, a flange extending outwardly at substantially 90° from one end of each of sides 11 and 12, base closure 19 extending from the outermost end of one of the outwardly extending flanges to the outward end of the other outwardly extending flange forming a closure between parallel sides 11 and 12, and flanges 13 and 14 projecting inwardly from the other end of sides 11 and 12, respectively, a distance forming slot 20 between the terminal ends 15 and 16 of flanges 13 and 14, respectively. It is preferred that slot 20 be continuous to permit the most flexible use of the sheet metal section, however, it is understood that slot 20 may be discontinuous and flanges 13 and 14 may join to enclose the top of the section in areas where it is not necessary to utilize sheet metal clips nor to permit material to flow into the box section. Slot 20 must be sufficiently large to permit concrete to readily flow through to the interior portion of the shape. The flow of concrete into the shape may be enhanced by holes, shown as 21 in FIG. 3, in sides 11 and 12. Slot 20 is of suitable width to receive clips to be further described below for holding metal decking to the structural shapes. Flanges 17 and 18 extend outwardly from the ends of walls 11 and 12, respectively, which are adjacent bottom closure 19. The depth of the sheet metal structural shape may be about two inches to about four inches suitable for use as a sub-purlin or a purlin for short spans and for an interior stud or an exterior wall mullion. The width of the box portion, or spacing between parallel sides, may be about 1½ to about 3 inches suitable for use as sub-purlins, purlins, interior studs or exterior wall mullions. Flanges 17 and 18 may vary in length suitable to support the desired insulation or roof structure. The flanges are formed of the sheet metal being doubled back on itself making the flanges double thickness. The flanges extend outwardly from each of the side walls about ½ to 1½ inches. It should be recognized that the above dimensions are governed by conventionally desired strength characteristics and to accommodate conventional deck or wall materials. The dimensions may be outside of the above ranges to obtain out-of-the ordinary strength or special material holding qualities.

The sheet metal structural shapes of this invention may be fabricated by well known roll forming techniques from sheet metal of about 22 gauge to about 12 gauge. It is preferable to use galvanized, commercial grade steel of 16 and 18 gauge.

Figure 2:
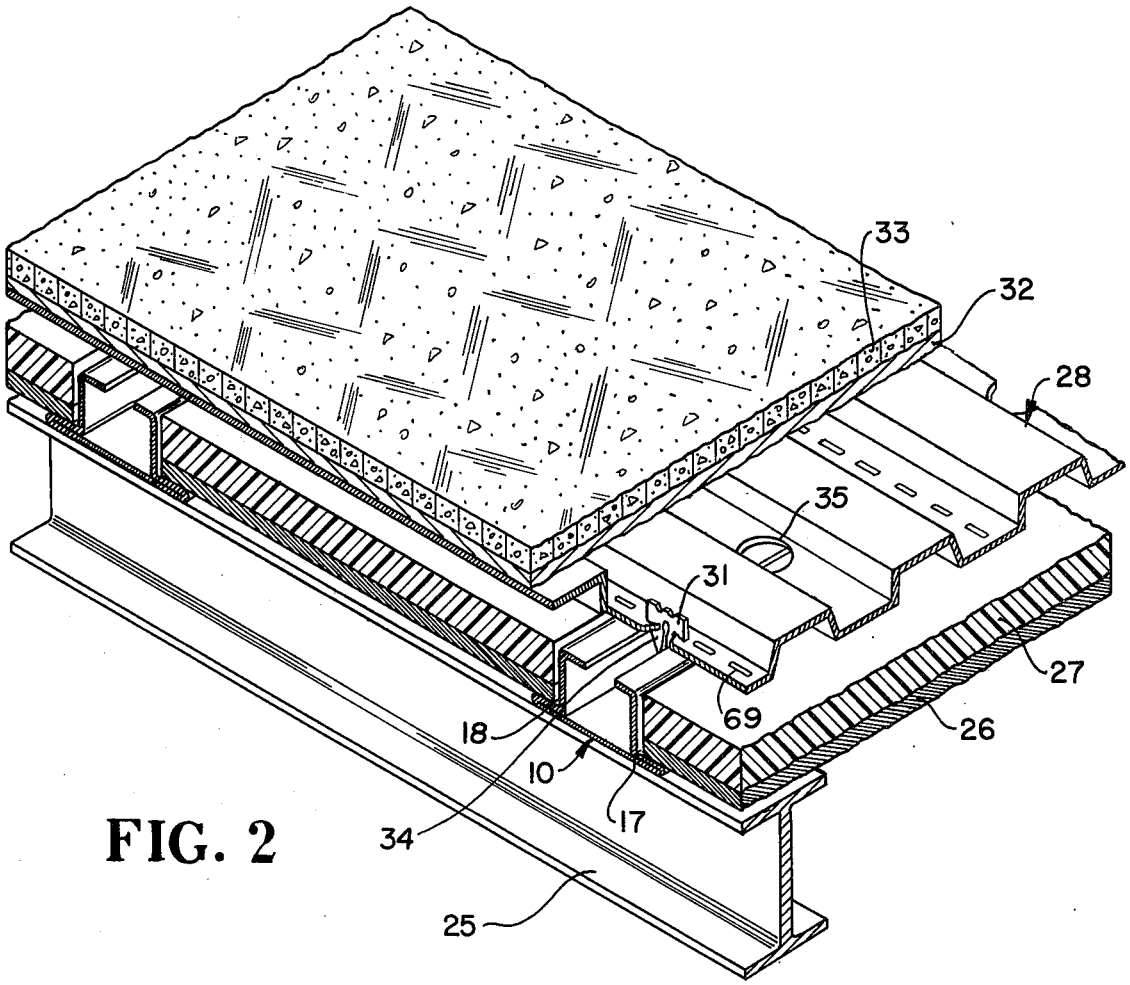
FIG. 2 is a perspective cutaway view of one embodiment of a sheet metal deck according to one preferred embodiment of this invention.

FIG. 2 shows one preferred deck structure according to this invention. FIG. 2 shows sheet metal structural shape 10, used as a sub-purlin, resting upon building structural beam 25. Following erection of building structural beams 25, sub-purlins 10 may be secured to the beams 25 by tack welding or other suitable attachment means at desired spacings to provide suitable strength characteristics and to accommodate insulation between adjacent sub-purlins. The insulation is laid between adjacent sub-purlins resting upon bottom flanges 17 and 18. As shown, formboard 26 rests upon lower flange 17 and supports insulation 27 above it. Any formboard providing desired strength characteristics of at least supporting its own weight and the weight of insulation 27 over the span between shapes, fire resistance and if desired, accoustical correction, may be used in the structure of this invention. Formboards for use in the dry structure as shown in FIG. 2 may be moisture permeable or impermeable and combustible or noncombustible as required. Gypsum, fiberglass, wood fiber, mineral fiber and asbestos cement formboards are suitable. Gypsum formboards, especially those having fire resistant additives such as vermiculite or perlite with fiberglass reinforcing, are especially suitable. When conventional gypsum formboards, without the high temperature resistant additives, have been used in the structure of this invention in conjunction with synthetic polymer insulation above the formboard, the conventional gypsum formboard has cracked and fallen from its position between the sub-purlins allowing molten plastic insulation to fall through upon exposure to flames. This can be overcome by use of gypsum board with fire resistant additives.

FIG. 2 shows insulation 27 located above formboard 26. Any suitable insulation material may be used. Conventional mineral wool, mineral fiber or fiberglass batting type or slab insulation may be used. An especially preferred insulation is synthetic organic polymer foam which provides good insulation properties and preferably a high temperature at which thermal decomposition occurs. Suitable foams include polystyrene, styrene-maleic anhydride, phenolic, such as phenol formaldehyde, polyurethane, vinyl, such as polyvinyl chloride and copolymers of polyvinyl chloride and polyvinyl acetate, epoxy, polyethylene, urea formaldehyde, acrylic, polisocyanurate and the like. Preferred foams are selected from the group consisting of polystyrene and polyurethane. Particularly suitable foams are closed cell foams which provide high insulating properties and low internal permeability to moisture. Such organic polymer foams are substantially rigid bodies of foam and are well known for their low density and outstanding thermal insulating properties. Previously, use of organic polymer foams in roof structures has been limited due to the need for care and special attention in installation if they are used alone and due to their decomposition at higher temperatures permitting structural damage. In accordance with this invention these disadvantages are overcome and polystyrene may be advantageously utilized.

The organic polymeric foam and the formboard are preferably preassembled by fastening the foam to the formboard by use of synthetic and natural adhesives or foaming the polymer in place. Suitable synthetic adhesives include epoxy, polyurethane, polyamide and polyvinylacetate and its copolymers. It is particularly desirable, since many of the formboards particularly suited for this invention are porous, to foam the organic polymer foam in place on top of the formboard in a plant operation. Such techniques are well known to the art. When the foam is foamed in place on top of a porous formboard, the foam will penetrate the pores of the formboard providing good adhesion between the foam and formboard layers and providing good waterproofing for the top surface of the formboard.

In some instances, where the insulation has sufficient rigidity and fire resistance, formboard 26 may be eliminated and the insulation rested directed upon flange 17. A particularly suitable insulation material for use in this manner is mineral fiber insulation board such as mineral fiber boards constructed of plastic bonded mineral fibers with an integral glass fiber mat facing reinforced with parallel glass fiber strands as sold by Forty-Eight Insulations, Inc., Aurora, Ill., under the trademark ALOYGLAS. This type of fiber board has a melting point at about 1600° F. as compared with conventional fiberglass formboard which melts at about 1050° F. The mineral fiber insulation board used in the structure of this invention should have a density of about 9 to 12 pounds per cubic foot. The thickness of the insulation when used alone or the insulation and the formboard should be such that the top of the insulation is approximately level with or below the top of the inwardly projecting top flanges 13 and 14 of sub-purlin 10.

The dry deck structure as shown in FIG. 2 may be totally insulated by pouring loose insulation such as perlite or vermiculite into the space between sides 11 and 12 of the structural shape.

FIG. 2 shows corrugated metal deck 28 which has upstanding portions 29 and corrugations 30. One especially preferred embodiment of this invention is to provide predented or prepunched areas for receiving clips 31, shown as 34 in corrugation 30, at spacings suitable for the spacing of the sub-purlins. Sheet metal clip 31 may be machine-driven through predented or prepunched areas 34 to securely hold sheet metal roof deck 28 in position and to provide uplift resistance. One preferred embodiment is for alternate corrugations to have clip receiving areas 34 and the other alternate corrugations to have holes 35. Holes 35 are in communication with the interior of box shape 10 permitting passage of poured concrete when desired and to provide ventilation. Decking 28 may also have perforations 69 which are small enough to prevent passage of concrete, but permit ventilation for bottom drying of concrete and ventilation of insulation. Utilization of the structure of this invention allows the use of thinner metal roof decks than previously used providing lightweight structures and further economies. Suitable gauges for use in the metal roof decks of this invention are about 22 to 28 gauge galvanized steel. Prior used metal roof decks were 18 to 22 gauge to accommodate the greater distance between joints or purlins. The metal decks may be 18 to 28 gauge, but the lighter gauge provide a more economical and lighter weight deck. Use of sub-purlins in the structure of this invention permits use of the lighter gauge metal decking. Prior structures using metal decks required different lengths of decking to accommodate different joist spacings. The structure of this invention used metal decking of a single length as a result of uniform sub-purlin spacing.

In the embodiment of the deck structure shown in FIG. 2, gypsum sheathing or other suitable insulation board, is placed above metal roof deck 28 with a weather seal coating 33 applied to exterior when the deck is used as a roof deck. The built-up roofing membrane may comprise alternate layers of roofing felt and hot asphalt with a waterproof wearing surface of tar and gravel. Any suitable waterproof wearing surface for flat type roofs is suitable for the roof structure of this invention.

If desired, additional insulation may be placed between sheating 32 and waterproof roof coating 33 or between sheathing 32 and metal deck 28. When additional insulation is used in this fashion, it is preferred that the insulation be one of the synthetic polymer foams set forth above with an additional layer of gypsum formboard between the insulation and the weather seal roofing material. When insulation is placed above deck 28, drying from breaks in the weather seal is enhanced by perforations 69, holes 35 and the general passage of air containing moisture through box shapes 10. The use of water permeable insulation 27 and formboard 26 also facilitates drying of insulation in the deck structure.

Prior to this invention, metal roof decks having more than about 1 inch equivalent fiberglass insulation with a fire rated suspended ceiling beneath have not, to my knowledge, obtained hourly fire ratings. The deck construction of this invention, as shown in FIG. 2, may provide an hourly fire rated insulated deck over a fire rated suspended ceiling. To obtain the hourly fire rated deck of the structure shown in FIG. 2, high temperature gypsum board (fire rated gypsum board) must be used in combination with insulation material which melts at less than about 250° F., such as polystyrene insulation board. While I do not wish to be bound by the theory of obtaining hourly fire ratings, it appears that melting of the polystyrene at about 220° F. reduces the insulation sufficiently to permit the heat built up between the suspended ceiling and roof to dissipate to the outside before the steel fails. The high temperature fire rated gypsum board retains its integrity and controls dripping of the molten polystyrene. A fire damaged roof may be repaired by replacement of the melted polystyrene foam by a foamed in place material pumped in from the ends of the spaces between sub-purlins or by addition of insulation to the exterior of the metal deck. The holes and perforations in the metal deck also facilitate heat dissipation.

The roof structure of this invention as shown in FIG. 2, provides a metal roof deck system which is lightweight and provides high insulating qualities. The structure is extremely versatile with respect to extent of insulation and fire resistance qualities.

Figure 3:
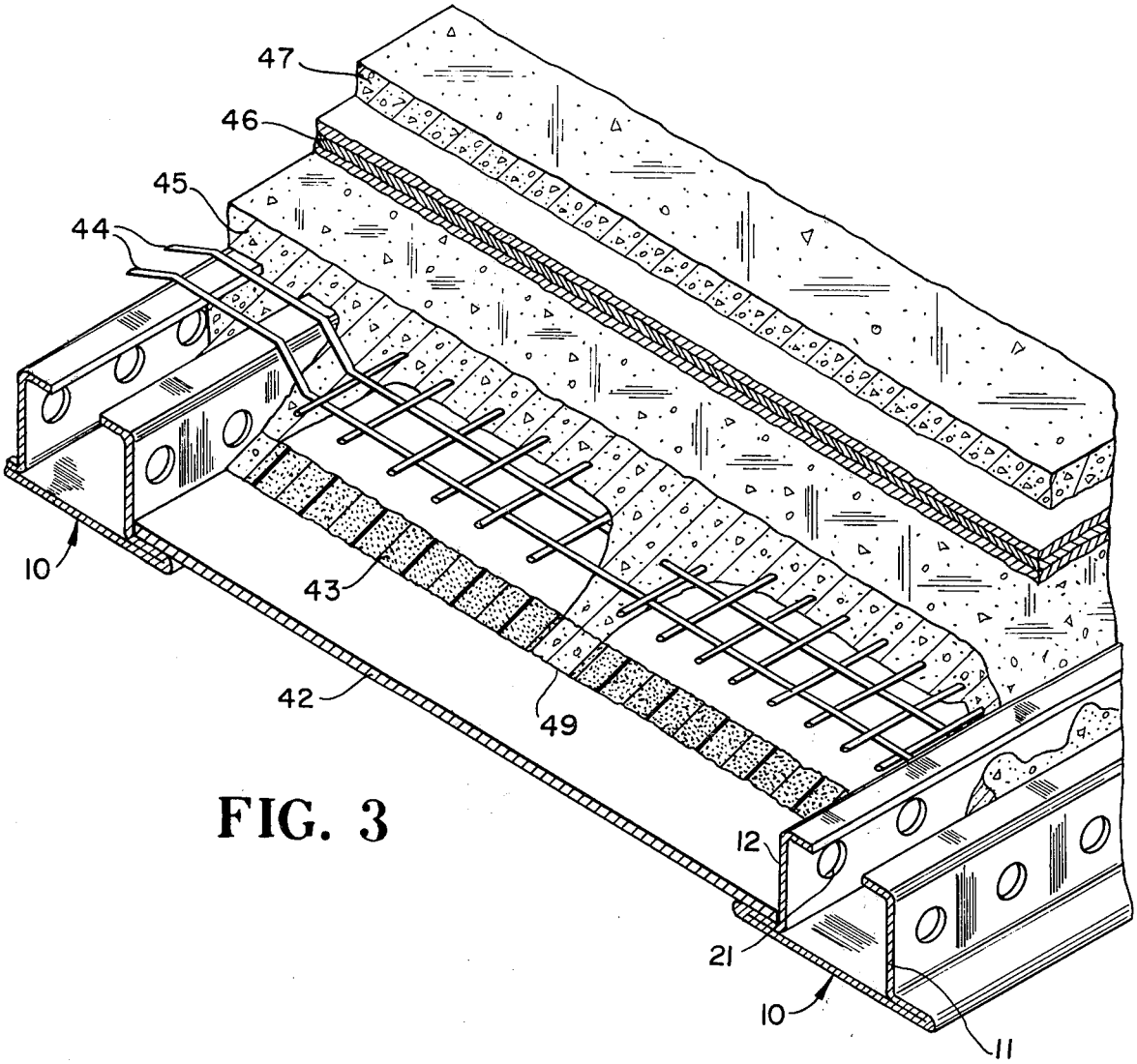
FIG. 3 is a perspective cutaway view of one embodiment of an insulated poured roof deck according to one preferred embodiment of this invention.

The sheet metal structural shapes of this invention may advantageously be used in poured concrete roof deck systems as shown in one preferred embodiment in FIG. 3. FIG. 3 shows sub-purlins 10 with moisture permeable formboard 42 resting upon their adjacent lower flanges. Formboard 42 has synthetic polymer foam or mineral fiber insulation on its upper surface providing open spaces 49 between adjacent strips of insulation. While open spaces 49 are shown as slots, they may be holes of round or other shape of sufficient size to allow flow of concrete therethrough. It is also desired that the edges of the insulation adjacent the structural shapes be set back from the edge of the formboard providing open space for concrete to encase the sides of the structural shape greatly increasing its fire resistance. It is preferred this set back be about ½ to 1 inch. The openings should be about 5 to about 20 percent of the area of the formboard. The formboards for use in this embodiment are those moisture permeable formboards which have relatively high melting points and structural resistance to combustion and heat damage when used in the laminated fashion of this invention. Particularly suitable formboards are mineral fiber boards such as mineral fiber structural boards constructed of plastic bonded mineral fibers with an integral glass fiber mat facing reinforced with parallel glass fiber strands as sold by Forty-Eight Insulations, Inc., Aurora, Ill., under the trademark ALOYGLAS formboard. This type of formboard has a melting point at about 1600° F. as compared with conventional fiberglass formboard which melts at about 1050° F. The mineral fiber formboard used in the structure of this invention should have a density of about 9 to about 12 pounds per cubic foot. Another suitable mineral fiber formboard is the rigid spun mineral fiber board such as sold by United States Gypsum Company under the trademark THERMAFIBER. Asbestos cement formboards and gypsum formboards having fire resistant additives such as vermiculite or perlite with fiberglass reinforcing are suitable. The above formboards are referred to as high temperature resistant formboard. Reinforcing mesh 44 is placed above sub-purlins 10 and concrete 45 poured above the insulation 43. Concrete 45 flows into openings 49 providing support for formboard 42 and providing bottom drying for concrete 45 through formboard 42 if a weather seal is placed above concrete 45 prior to complete drying. Also, concrete 45 fills the interior portions of sub-purlins 10 and the open slots along the outside of the sides of the sub-purlins providing excellent uplift resistance, fire resistance and additional strength to the sub-purlins. A concrete beam structure is formed with the sub-purlin as reinforcing. Built-up layers of tar and roofing paper shown as 46 may be applied above the concrete and wearing surface of tar and gravel 47 applied to the exterior of the built-up roofing.

The concrete utilized may be preferably standard gypsum concrete, however, modified concretes containing various fillers, such as perlite, aggregate for thermal insulation and lighter weight are suitable, but not necessary in the roof structure of this invention. Gypsum concrete is especially desirable for use in roof structures not only because it is incombustible but also because the gypsum concrete sets within a few minutes to form a slab that is hard enough to walk upon thereby permitting, in many cases, a waterproof wearing surface to be laid the same day the slab is poured. When any type of portland cement is used, the setting time is much slower and to prevent moisture from sagging the formboard, I have found it may be desirable to place a moisture permeable sheet between the cement and the top surface of the formboard. However, I have found that using the structure shown in FIG. 2, lightweight concrete may be poured over gypsum formboard which, to my knowledge, has not previously been possible. The lightweight concrete is especially suitable for the structure shown in FIG. 3.

The drying of the concrete continues by removal of moisture from the concrete for several weeks after pouring. I have found that in the deck structure of this invention the drying time of the concrete is not greatly increased over conventional poured deck. This results from the concrete being in direct contact with the formboard which is porous to water. The continued drying of the concrete after a built-up type roofing membrane is applied to its exterior, continues by the moisture escaping through the formboard. The holes or slots in the sides of the box shape also aid in drying the concrete within the box shape.

The roof structure of this invention as shown in FIG. 3, provides an economical roof structure having high insulating properties, two hour fire ratings and provides a structure in which insulation may be replaced if fire damage does result. Under high heat conditions the organic polymer foam may decompose. However, the concrete filling the vertical slots or holes through the foam and resting upon the gypsum formboard serve to support and unitize the roof structure even if the polymer foam completely disintegrates. The disintegrated foam may be replaced by a suitable foamed in place material.

Figure 4:
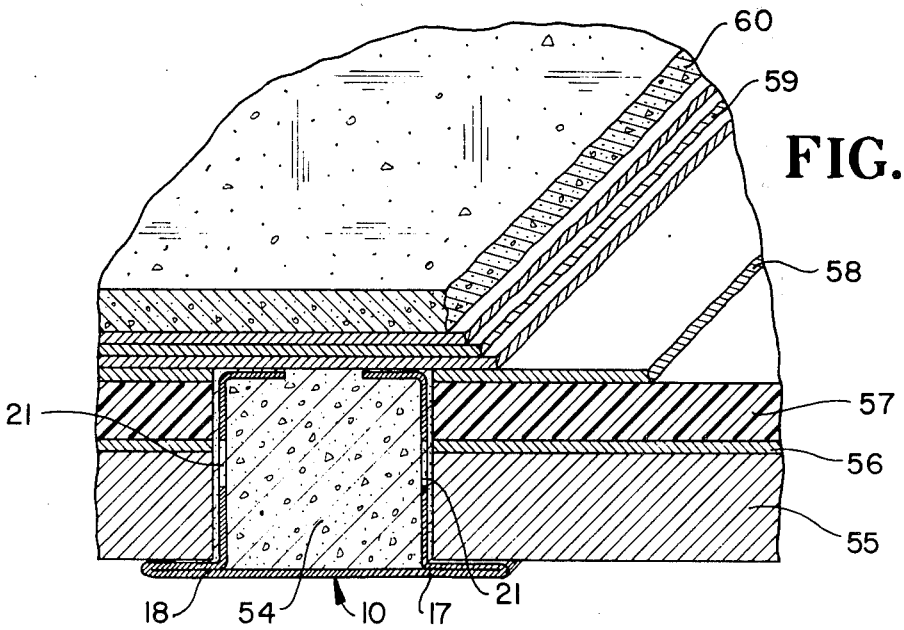
FIG. 4 is a perspective sectional view of an insulated precast roof deck according to one embodiment of this invention.

FIG. 4 shows another embodiment of deck construction according to this invention. In FIG. 4 sub-purlins 10 are shown with precast structural decking 55 resting upon the lower outwardly extending flanges 17 and 18 of sub-purlin 10. The precast deck structure 55 may be any suitable precast concrete structure or precast wood fiber cement-bonded board roof decking. Preferably insulation 57 is synthetic polymer foam insulation as further described above, with incombustible gypsum boards 56 and 58 both below and above the foam to enhance fire resistance of the deck structure. Fire resistance of the deck structure is enhanced by grout 54 which fills the interior of subpurlin 10, flows through holes 21 in the parallel side walls of the sub-purlin and fills the space adjacent the sub-purlin and the prefabricated decking and insulation. Holes 21 also aid in drying of the mortar within the box shape. Built-up roofing of the tar and tar paper layers are shown as 59 and weather seal coating 60 when the deck is to be used as a roof deck. The sub-purlin of this invention provides high fire resistance to structures utilizing prefabricated decking due to its being filled with grout material and thereby providing substantial encasement of the metal sub-purlin structure and increasing its structural strength.

Figure 5:
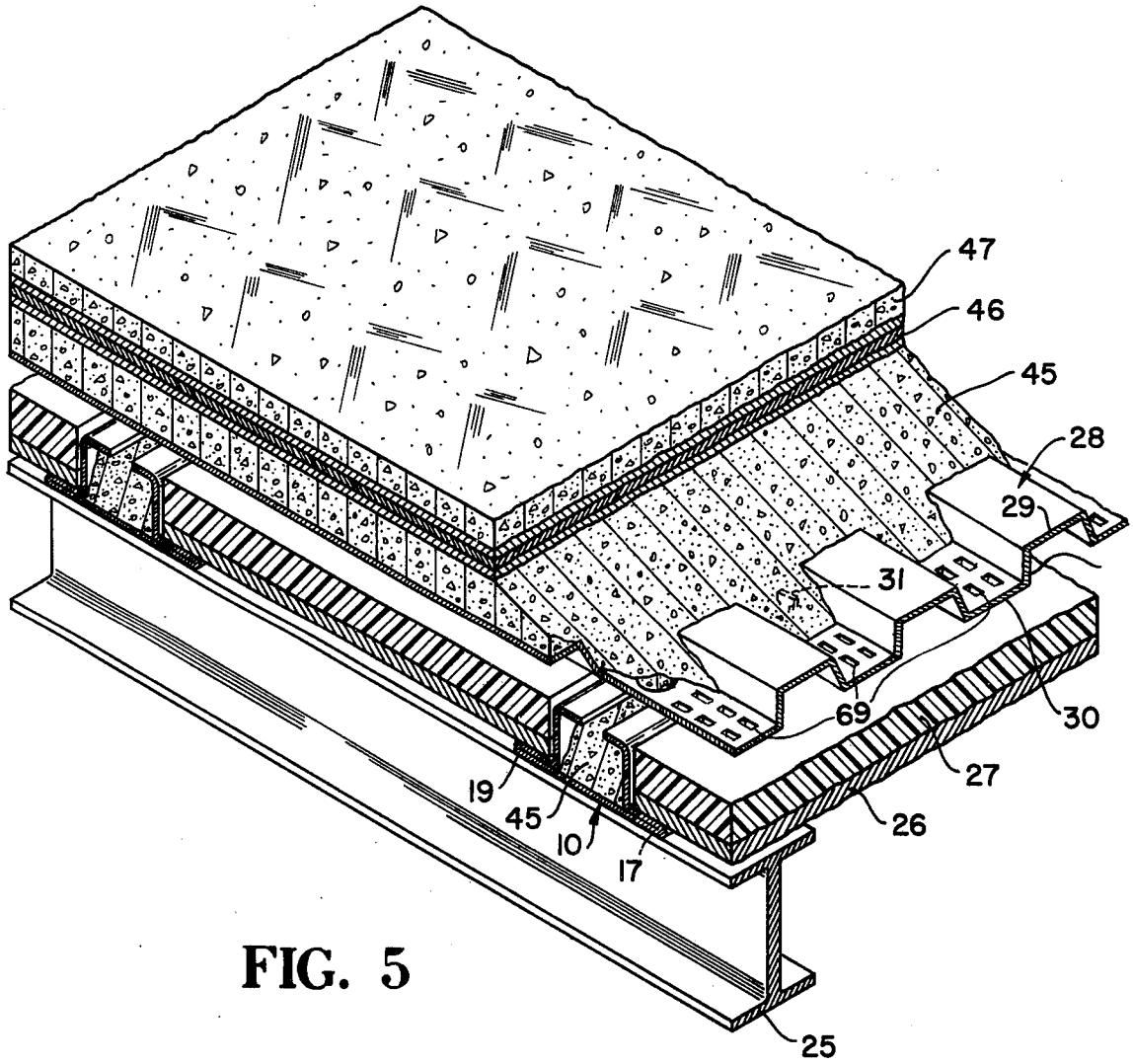
FIG. 5 is a perspective cutaway view showing a combination poured-metal insulated roof deck according to one preferred embodiment of this invention.

FIG. 5 shows a preferred embodiment of a combination metal roof deck - poured concrete deck structure according to this invention. The deck structure shown in FIG. 5 provides an insulated lightweight and economical decking and roof structure which provides high insulation and an hourly fire rated structure. The structure beneath metal roof deck 28 is the same as described previously with respect to FIG. 2, but must be moisture pervious. The configuration of metal roof deck 28 for use with the poured concrete embodiment of this invention is the same as described with respect to FIG. 2 having perforations 69 to permit passage of moisture and holes 67 to permit passage of concrete. In the embodiment shown in FIG. 5, the metal roof deck must have sufficient holes 67 so that the concrete flows into the interior of the sheet metal subpurlin. I have found that alternate corrugations should be predented or prepunched for clips 31 while the other alternate corrugations should have holes or slots 67 as large as possible to permit flow of the concrete into the sub-purlin. This provides excellent structural integrity and uplift resistance. The weatherproof surface shown as 46 and 47 may be applied above the concrete as previously described. Concrete 45 is preferably gypsum or lightweight concrete. In a roof deck to which a moistureproof weather surface has been applied, drying is completed through the bottom of the roof. The moisture passes from the concrete through perforations 69 in the metal deck through the moisture pervious insulation 27 and formboard 26. Drying of the concrete inside the sub-purlin is facilitated by holes through the side walls providing direct contact with the moisture pervious insulation. The roof structure shown in FIG. 5 is especially suitable for lightweight concrete which contains a large amount of water. The water which drips through perforations 69 is absorbed by the insulation and does not cause unsightly and bothersome puddles on the floor which require removing. A particularly preferred embodiment of this invention as shown in FIG. 5 uses mineral fiber boards of plastic bonded mineral fibers as described above for formboard 26 and insulation 27 and uses lightweight concrete for the poured concrete.

Figure 6:
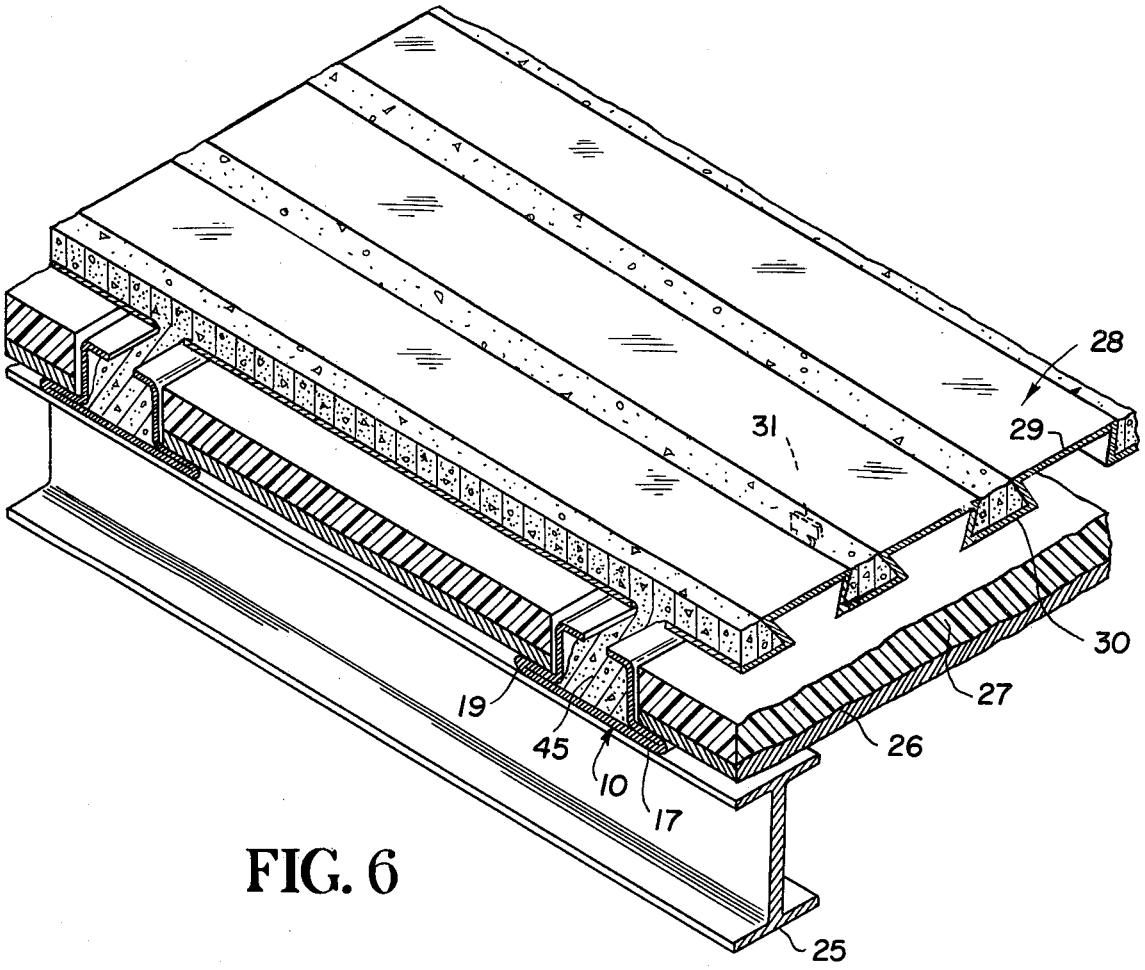
FIG. 6 is a perspective cutaway view of an insulated, synthetic polymer sheet roofing structure according to one preferred embodiment of this invention.

FIG. 6 shows another embodiment of this invention using a corrugated structural sheet as the roof decking. As shown in FIG. 6, sheet decking 28 has corrugations 30 with sides 65 and 66 of the corrugations diverging so that the bottom of the corrugations are wider than the open space between upstanding portions 29. Especially suitable for this type of roof decking is synthetic polymeric sheet roofing material.

The synthetic polymeric sheet roofing material for use in this embodiment may be any polymeric material which provides for desired structural strength and retention of such properties without appreciable degradation from sunlight and weather. The polymeric sheet is both the structural component of the integrated deck structure of this invention and the weather surface. Any polymeric material meeting the above standards is suitable.

One particularly suitable thermoplastic corrugated sheet material is biaxially oriented corrugated polyvinyl chloride sheets. The biaxially oriented polyvinyl chloride sheets maintain good mechanical properties and light transmission property with sustained exposure to ultraviolet light and weathering. Further, the impact strength of the biaxially oriented polyvinyl chloride corrugated sheets is high and permits use of such sheet polymeric material as the structural component of roof decks. A particularly suitable biaxially oriented polyvinyl chloride corrugated sheet material is currently offered by Solvay & Cie SA, Brussels, Belgium, under the trade name Selchim HR. The production of these biaxially oriented polyvinyl chlorides is set forth in more detail in U.S. Pat. Nos. 3,661,994, 3,744,952, U.K. Pat. Nos. 1,353,447 and 1,365,041. Such materials are available permitting passage of the solar energy downward through the polymeric sheet roofing to the solar collectors or in various opaque colors which reflect the solar energy to enhance the insulation properties of the roof deck. It is seen from FIG. 6 that the corrugated sheet roofing may be fastened to the sub-purlins with clips 31 or may be screw applied to the upper flanges of the sub-purlin. After installation, the corrugations are filled with any suitable caulk material to a level of upstanding portions 29. This seals the fastenings, fills the sub-purlin with the caulk material when a cementious material is used and provides a smooth, traffic-bearing roof surface. The exterior of the polymeric roofing provides the weather surface eliminating costly standard built-up roofing and its costly maintenance. The roof structure shown in FIG. 6 provides a very lightweight, economical insulated roof deck structure.

Figure 9:
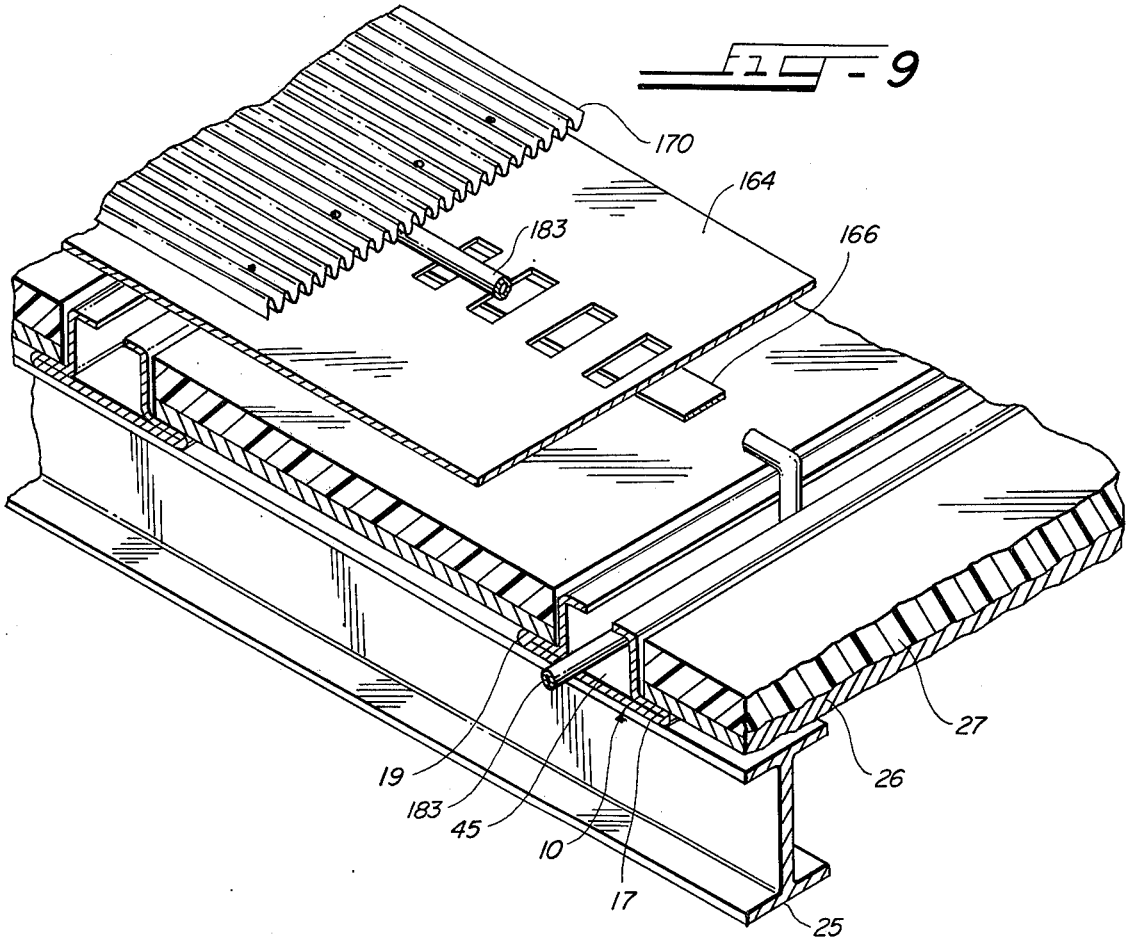
FIG. 9 is a perspective cutaway view of an insulated solar energy absorbing roof structure according to one preferred embodiment of this invention.

The roof deck structure as shown in FIG. 6 may be readily adapted to the solar energy absorbing roof deck similar to that described in my co-pending allowed U.S. Patent application Ser. No. 630,504 now U.S. Pat. No. 4,006,731. In the roof deck as shown in FIG. 9 of the present application, the solar energy absorber plate 164 is placed adjacent the top of insulation 27 to absorb solar energy passing through the polymeric roofing 170. Pipes 183 carrying a heat transfer fluid from the absorber plate 164 may be conveniently placed within structural shape 10. Suitable solar energy reflecting surfaces 166 as described in my earlier application may be used.

The roof structure of this invention provides properties which are presently being called for by newer building regulations. The first such property is fire ratings which, following suitable ASTM testing, result in two hour fire ratings for the roof structure. The second important property is thermal insulation combined with the satisfactory fire rating. Present energy conservation considerations result in a "U" value of 0.10 and less being desirable. Calculations show that roof structures of this invention utilizing the sheet metal shape as a purlin and using polystyrene and gypsum concrete result in "U" values of 0.06 and less. When the sheet metal shape is utilized as a sub-purlin with ½ inch gypsum formboard, 1½ inch polystyrene foam board and 2 inch gypsum concrete the "U" value is 0.10. Thus, an inexpensive deck is provided having both a two hour fire rating for Class 1 fire rated construction and insulation properties resulting in "U" values of 0.10 and less. Further, a range of desired insulating properties may be achieved by varying the thickness of the synthetic polymer foam.

Any suitable ceiling structure may be installed beneath the roof structure of this invention as long as suitable ventilation is furnished. However, in contrast to prior roof structures, it is not necessary that the ceiling provide the insulation or fireproofing qualities. The roof structure of this invention provides insulation and fireproof properties without any structure beneath it and may be left exposed. Further, when the sheet metal shape of this invention is used directly as a purlin, about one foot of interior occupancy space is gained over conventional construction using exposed joists which must also be fireproofed.

Figure 8:
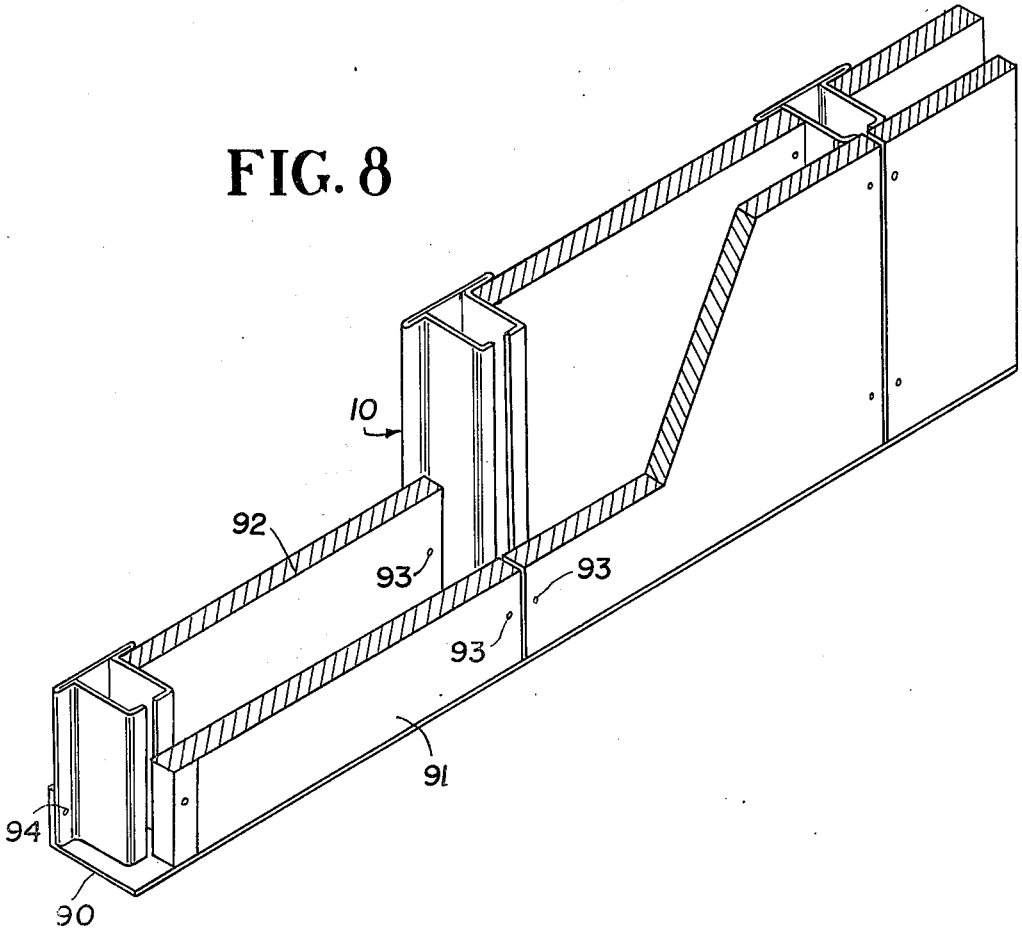
FIG. 8 is a perspective cutaway view of another preferred embodiment of a wall structure according to this invention.

One preferred embodiment of a wall structure according to this invention is shown in FIG. 8. The wall structure shown in FIG. 8 is especially well suited for interior and shaft walls. The wall structure shown in FIG. 8 spans the distance between floors or between a floor and a ceiling or roof structure. The wall structure is erected by placing a suitable anchoring structure at the base of the wall, such as sill angle 94, and the corresponding structure at the top or a cap angle. Any suitable shape may be used which provides a backing against which to fasten the sheet metal studs 10 and not obstructing entry of the wall board from the narrow side of studs 10. For example, a channel may be used at the base and an angle at the top. Studs 10, being of sheet metal, may be readily cut to suitable length at the job site, erected at desired spacings and fastened to the sill structure at the bottom and the corresponding cap structure at the top. The sheet metal studs may be spot welded or attached in any other suitable fashion known to the art, shown as fastening means 94. It should be noted that in the structure of this invention, all of the studs may be put into place at the desired spacing as soon as the sill and cap structures are installed, thus, affording quick and safe protection of open shafts and the like. The studs may be completely installed from the building side of the shaft without the necessity for scaffolding or even leaning into the shaft area. After the spaced studs are erected, the inner shaft wall spaced studs are erected, the inner shaft wall filler board 92 may be attached to the studs from the building side of the shaft simply by placing the wall board against the flanges of the studs as shown in FIG. 8 and applying screws shown as 93 at desired locations through the inner shaft wall and into the stud flange.

Outer shaft wall 91 may be applied by placing the outer shaft wall board in the desired position and applying screws or other fastenings through the outer shaft wall board and the flat portion of the inwardly opposed flanges of the stud. Thus, the entire double wall assembly may be completely assembled from one side.

A preferred embodiment of a shaft wall is shown in FIG. 8 wherein the studs are spaced on centers of the width of standard available wall board. The inner shaft wall board 92 is cut narrower than the outer shaft wall board 91 to provide insert 97 which fits between the parallel sides of the structural shape thus providing additional fire resistance to the wall structure. Of course, the space between inner shaft wall 92 and outer shaft wall 91 as well as the interior of the structural shape may be filled with any type of insulation material desired. The wall closure material fastened to the flanges of adjacent structural shapes may be of any suitable material. As shown in FIG. 8, with particular reference to shaft wall construction, gypsum board may be used in interior construction. Alternatively, plywood, various composition boards, metal panels and a wide variety of composition panels with various desired interior surface finishes, may be used to obtain texture, color and accoustical properties. The wall construction of this invention is also suitable for exterior walls and in such cases, the wall closure material facing the exterior would suitably be a weather-resistant material and may be faced with any desired texture or colored material to obtain the desired appearance. For example, Venetian corrugated metal which is available in long rolls and surfaced in a variety of stone and brick textures may be readily cut to length at the job site and applied with self-tapping screws. In exterior construction as well as interior, the structural shape of this invention may be filled with any suitable insulation material or may be filled with gypsum concrete to provide added fire resistance.

Figure 7:
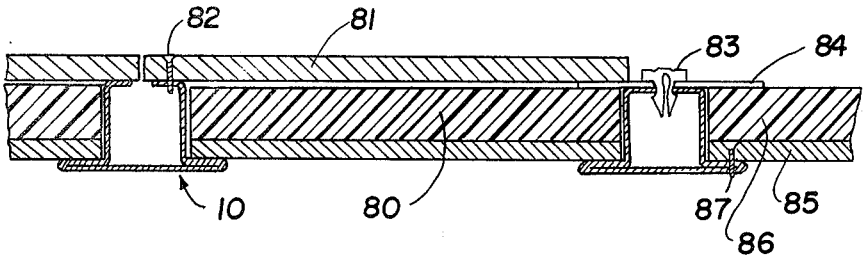
FIG. 7 is a sectional view of a wall structure according to one preferred embodiment of this invention.

FIG. 7 shows another embodiment of a preferred wall of this invention. Studs or mullions 10 are spaced in parallel relationship to each other at the desired distance for structural strength and for spanning with wall board assembly comprising wall board 81 and insulation 80. The assembly may be screw applied as shown by screw 82 or be clip applied as shown by clips 83. In the cross-sectional view shown in FIG. 7, the space between adjacent mullions is filled by wall board 81 to which foam 80 with a suitable outer surface may be attached or foamed in place. Also shown in FIG. 7 is an alternate assembly wherein wall board 85 rests upon outstanding flanges of the stud and secured by fastening means 87. Insulation 86 is adhered to rigid decorative backing 84 which is prepunched for fasteners 83. Thus, it is seen that any suitable wall closure material may be used.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. An insulated deck structure comprising:

a series of parallel sheet metal structural shapes which are symmetrical about a vertical bisecting plane having:

opposing generally parallel equal length sides, a flange extending outwardly at substantially 90° from one end of each of said sides, a base closure extending from the outermost end of one of said outwardly extending flanges to the outward end of the other of said outwardly extending flanges forming a closure between said parallel sides at said one end, and flanges projecting inwardly from the other end of each of said parallel sides a distance forming a slot between the terminal ends and said inwardly projecting flanges;

corrugated structural decking above and resting upon the inwardly extending flanges of said structural shapes; and insulation board resting on said outwardly extending flanges and extending between adjacent structural shapes beneath said corrugated structural decking.

2. The insulated deck structure of claim 1 wherein said insulation board is mineral fiber.

3. The insulated deck structure of claim 2 wherein said insulation board is a plastic bonded mineral fiber board having a density of about 9 to about 12 pounds per cubic foot.

4. The insulated deck structure of claim 1 wherein said insulation board consists of a lower rigid portion gypsum formboard and an upper portion of foam.

5. The insulated deck structure of claim 1 wherein said structural decking is corrugated metal decking of about 22 to about 28 gauge thickness.

6. The insulated deck structure of claim 5 wherein said corrugated metal decking has perforations sized to prevent the general flow of concrete therethrough and to allow the passage of moisture therethrough and additionally has holes sufficiently large to permit the passage of concrete therethrough located over the slots in said structural shapes.

7. The insulated deck structure of claim 6 wherein said insulation board is a moisture pervious board.

8. The insulated deck structure of claim 7 wherein poured concrete is above said corrugated metal decking and flows through said holes into the interior portion of said structural shapes, the concrete continuing drying by escape of moisture through the perforations in said corrugated metal roof deck and through said moisture pervious insulation board.

9. The insulated deck structure of claim 8 wherein said concrete is lightweight concrete having a weatherproofing seal applied to its exterior surface.

10. The insulated deck structure of claim 8 wherein said concrete is gypsum and a weatherproof seal is applied to its exterior surface.

11. The insulated deck structure of claim 5 wherein said corrugated metal decking is fastened to said sheet metal structural shapes by clips extending through holes in the corrugations of said decking and through said slot between the terminal ends of the inwardly projecting flanges of said structural shapes and having a wedging action beneath said inwardly projecting flanges to securely hold said deck to said structural shapes.

12. The insulated deck structure of claim 1 wherein said structural decking is corrugated plastic.

13. The insulated deck structure of claim 12 wherein said plastic is biaxially oriented polyvinyl chloride.

14. The insulated deck structure of claim 13 wherein a solar energy absorber plate is adjacent the top of said insulation to absorb solar energy passing through said plastic.

15. An insulated deck structure comprising:

a series of parallel sheet metal structural shapes which are symmetrical about a vertical bisecting plane having opposing generally parallel equal length sides, a flange extending outwardly at substantially 90° from one end of each of said sides, a base closure extending from the outermost end of one of said outwardly extending flanges to the outward end of the other of said outwardly extending flanges forming a closure between said parallel sides at said one end, and flanges projecting inwardly from the other end of each of said parallel sides a distance forming a slot between the terminal ends of said inwardly projecting flanges;

moisture pervious formboard resting on said outwardly extending flanges and extending between adjacent structural shapes having synthetic polymeric foam insulation secured to the upper surface thereof, said insulation having openings therethrough and along the edge of the insulation adjacent each of said structural shapes, said openings having an area of about 5 to about 20 percent of the area of said insulation;

wire reinforcing mesh above said foam formboard;

poured concrete above said reinforcing mesh flowing through said openings and contacting said formboard, adherence of concrete to said formboard preventing sagging of the formboard and the concrete continuing drying by escape of moisture through the moisture pervious formboard in the areas of contact between the concrete and the formboard and the concrete flowing to the interior portion of said structural shapes forming an integrated roof deck structure resulting in reinforced beam structures including said structural shapes; and a waterproof wearing surface to the exterior of the poured concrete.

16. The insulated deck structure of claim 15 wherein said insulation comprises two strips of foam having an opening between them at about the midpoint of the formboard whereby a continuous beam of concrete is adhered to the formboard at about its midpoint.

17. The insulated deck structure of claim 16 wherein said concrete is gypsum and a weatherproof seal is applied to its exterior surface.

18. The insulated deck structure of claim 16 wherein said concrete is lightweight concrete and a weatherproof seal is applied to its exterior surface.

19. The insulated deck structure of claim 16 wherein said formboard is gypsum board and said insulation is polystyrene.

* * * * *